US009376124B2

(12) United States Patent
Thomas

(10) Patent No.: US 9,376,124 B2
(45) **Date of Patent: *Jun. 28, 2016**

(54) PROTECTIVE STRUCTURE FOR TANK TOP FITTINGS

(71) Applicant: Gunderson LLC, Portland, OR (US)

(72) Inventor: Bradley J. Thomas, Beaverton, OR (US)

(73) Assignee: Gunderson, LLC, Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/875,292

(22) Filed: Oct. 5, 2015

(65) Prior Publication Data

US 2016/0023669 A1 Jan. 28, 2016

Related U.S. Application Data

(63) Continuation of application No. 14/251,473, filed on Apr. 11, 2014, now Pat. No. 9,180,893.

(51) Int. Cl.
*B61D 5/00* (2006.01)
*B65D 90/00* (2006.01)

(52) U.S. Cl.
CPC ..... *B61D 5/08* (2013.01)

(58) Field of Classification Search
CPC ..... B61D 5/00; B61D 5/06; B61D 5/08; B61D 5/04
See application file for complete search history.

(56) References Cited

U.S. PATENT DOCUMENTS 2,102,124 A 12/1937 Lithgow
2,558,648 A 6/1951 Gausmann
3,599,575 A 8/1971 Yurkoski et al.
3,785,298 A * 1/1974 Reynolds ..... B61F 5/305 105/218.1
3,897,736 A * 8/1975 Tack ..... B61F 5/26 105/222
3,994,239 A 11/1976 Baker et al.
4,192,240 A * 3/1980 Korpics ..... B61F 5/32 105/224.05
4,203,371 A * 5/1980 Tack ..... B61F 5/32 105/218.1
4,217,830 A 8/1980 Himmelheber, Sr.
4,304,271 A 12/1981 Mowatt-Larssen
4,313,384 A * 2/1982 Holden ..... B61F 5/32 105/225
4,428,303 A * 1/1984 Tack ..... B61F 15/06 105/218.1
4,466,356 A 8/1984 Messersmith et al.
4,527,489 A * 7/1985 Schlink ..... B61D 5/08 105/358
4,542,764 A 9/1985 Brittingham et al.
4,674,674 A 6/1987 Patterson et al.
4,805,540 A 2/1989 Mundloch et al.

(Continued)

OTHER PUBLICATIONS

Kathi Kube, Rollover Tank Car Test, web posting, Dec. 23, 2009, article appearing on Trains Magazine web site, article downloaded from URL http://trn.trains.com/railroads/2009/12/rollover-tank-car-test on Feb. 12, 2015.

*Primary Examiner* — Jason C Smith
(74) *Attorney, Agent, or Firm* — Chernoff, Vilhauer, McClung & Stenzel, LLP

(57) ABSTRACT

A railway tank car including a protective structure for the top of its cargo tank and surrounding both a valve group mounting nozzle and a pressure-relief safety valve nozzle, to protect the associated valves against damage resulting from the car being overturned, particularly while the railcar is moving along a railway. The protective structure includes protective housings including upstanding walls of metal plate construction surrounding the nozzles yet not attached directly to the nozzles, so that the protective housings afford convenient access to the valves associated with the nozzles.

10 Claims, 8 Drawing Sheets

(56) References Cited

U.S. PATENT DOCUMENTS 4,915,031 A * 4/1990 Wiebe ..... B61F 5/125 105/198.2
4,941,410 A 7/1990 Dalrymple et al.
5,218,911 A * 6/1993 Rehbein ..... B61D 5/00 105/358
5,351,625 A 10/1994 Culligan et al.
5,404,826 A * 4/1995 Rudibaugh ..... B61F 5/32 105/222
5,465,753 A 11/1995 Schwartz
5,467,719 A * 11/1995 Dalrymple ..... B61D 5/06 105/362
5,509,358 A * 4/1996 Hawthorne ..... B61F 5/32 105/218.1
5,794,538 A * 8/1998 Pitchford ..... B61F 5/32 105/218.1
5,924,366 A * 7/1999 Trainer ..... B61F 5/32 105/206.1
6,234,083 B1 * 5/2001 Tack, Jr. ..... B61F 5/305 105/222
6,357,363 B1 3/2002 Miltaru
6,390,119 B1 * 5/2002 Crochet ..... F16K 27/08 105/360
6,422,155 B1 * 7/2002 Heyden ..... B61F 5/32 105/222
6,742,550 B2 * 6/2004 Caparros ..... B65D 90/10 137/347
6,910,427 B2 * 6/2005 Woodall ..... B65D 90/10 105/358
6,949,415 B2 9/2005 Alcoe et al.
7,497,169 B2 * 3/2009 Forbes ..... B61F 5/122 105/218.1
7,739,961 B2 * 6/2010 East ..... B61F 5/305 105/218.1
7,849,801 B2 * 12/2010 Dalrymple ..... B61D 5/08 105/358
7,849,802 B2 * 12/2010 Dalrymple ..... B61D 5/08 105/358
9,180,893 B2 * 11/2015 Thomas ..... B61D 5/08
2002/0195019 A1 12/2002 Woodall
2003/0141586 A1 7/2003 Alcoe et al.
2004/0164401 A1 8/2004 Alcoe et al.
2006/0185554 A1 8/2006 Dalrymple et al.
2007/0125259 A1 6/2007 Dalrymple
2008/0035015 A1 2/2008 Simpson et al.
2008/0265094 A1 10/2008 Van Der Veen et al.
2010/0319571 A1 12/2010 Dalrymple et al.
2012/0186486 A1 * 7/2012 Tavares ..... B61F 5/32 105/224.1
2012/0234202 A1 * 9/2012 Tavares ..... B61F 5/32 105/225
2014/0000474 A1 1/2014 McKisic
2014/0216298 A1 * 8/2014 Tavares ..... B61F 5/32 105/225
2015/0291184 A1 * 10/2015 Thomas ..... B61D 5/08 105/358

* cited by examiner

PROTECTIVE STRUCTURE FOR TANK TOP FITTINGS

CROSS REFERENCE TO RELATED APPLICATION

In accordance with 37 C.F.R. §1.76, a claim of priority is included in an Application Data Sheet filed concurrently herewith. The present application claims priority under 35 U.S.C. §120 to pending U.S. patent application Ser. No. 14/251,473, entitled "Protective Structure for Tank Top Fittings", filed Apr. 11, 2014, and is a continuation thereof.

BACKGROUND AND SUMMARY OF THE INVENTION

The present invention is related to railway tank cars and in particular to a protective structure for the various valves ordinarily present on the top of a cargo tank of such a railway tank car.

Nozzles have long been provided on the top of a railway tank car as manways and as locations for mounting groups of valves, including those used to fill a cargo tank with a fluid cargo, to remove the fluid cargo from the cargo tank, and to protect against excessive internal pressure. It has long been recognized that the nozzles are susceptible to being broken loose from the tank and that the valves can be broken in the event of a rollover of a railway tank car. Various protective housings have been used in the past, but they have been attached to a nozzle or a valve-mounting plate fastened to a nozzle. Various strengthened and reinforced nozzle structures have been provided in order to resist breakage of the nozzles in the case of a rollover, but previously known protective structures have failed when tank cars have overturned while moving along a railway.

Railway industry regulations require structures intended to protect tank top fittings on railway tank cars to be able to withstand longitudinally-applied forces equal to the weight of the cargo tank and its lading, and to be able to withstand laterally-applied forces of half that magnitude well enough to prevent failure of the fittings protected by such structures.

At least until recently, it had been considered unnecessary and an undesirable addition of weight to a railroad tank car to provide a strong protective structure surrounding a manway nozzle or a valve group nozzle on the top of a railroad tank car. Instead, welded gussets and various arrangements of strengthening of the attachment of a nozzle to the top of a cargo tank had been used in the past, as well as protective bells that can be attached to the valve group mounting plate to surround the valves and protect the valves themselves from damage in collisions and overturning. While previously available protection for the top of a tank car has value, various events have recently proven that protection to be insufficient in the case of overturning of railroad tank cars in motion along a railroad track.

What is needed, then, is a substantial yet not overly massive structure for protecting the various valves on the top of a cargo tank of a railway tank car, to prevent loss of cargo, and particularly to prevent escape of dangerous gaseous cargo or flammable liquid cargo, in the event of derailment and overturning of a moving railway tank car. Such a protective structure should not be so heavy as to add significantly to the fuel requirements for moving the car along the railway, yet it should be of ample strength. It is desirable also to have a protective structure on the top of a cargo tank be no larger than necessary, in order that it be a smaller target which can collide with an obstruction on the ground in the case of a rollover.

A railway tank car that includes one embodiment of the invention disclosed herein, a substantial mounting, or bolting, flange is mounted in a first opening in the top of the cargo tank at a position lower than the position of a bolting flange for receiving a mounting plate for groups of valves and related fittings in a traditional nozzle.

In one embodiment of the structure disclosed herein for the top of a cargo tank of a railway car a protective housing of plate metal extends upward from the top of the cargo tank and surrounds the nozzle for a valve group bolting flange and a mounting plate bolted to the flange, extending upward at least to the height of the highest valve or other fitting mounted on the valve group mounting plate.

In one embodiment of the structure of the top of a cargo tank for a railway tank car as disclosed herein a pressure-relief safety valve is mounted on a flange carried on a nozzle located at a second opening through the tank top, spaced apart from the valve group and fittings nozzle, and an auxiliary protective housing of metal plate construction extends around the nozzle and flange and has a pair of parallel side portions extending to and attached to the protective housing surrounding the valve group nozzle and its bolting flange. The auxiliary housing also acts as a bolster to help support the protective housing surrounding the valve group mounting plate.

In one embodiment of the auxiliary protective housing surrounding the pressure-relief safety valve nozzle may be upwardly open to provide a path for fluids escaping through the pressure-relief valve.

The foregoing and other objectives and features of the invention will be more readily understood upon consideration of the following detailed description of the invention taken in conjunction with the accompanying drawings.

DETAILED DESCRIPTION OF AN EMBODIMENT

Figure 1:
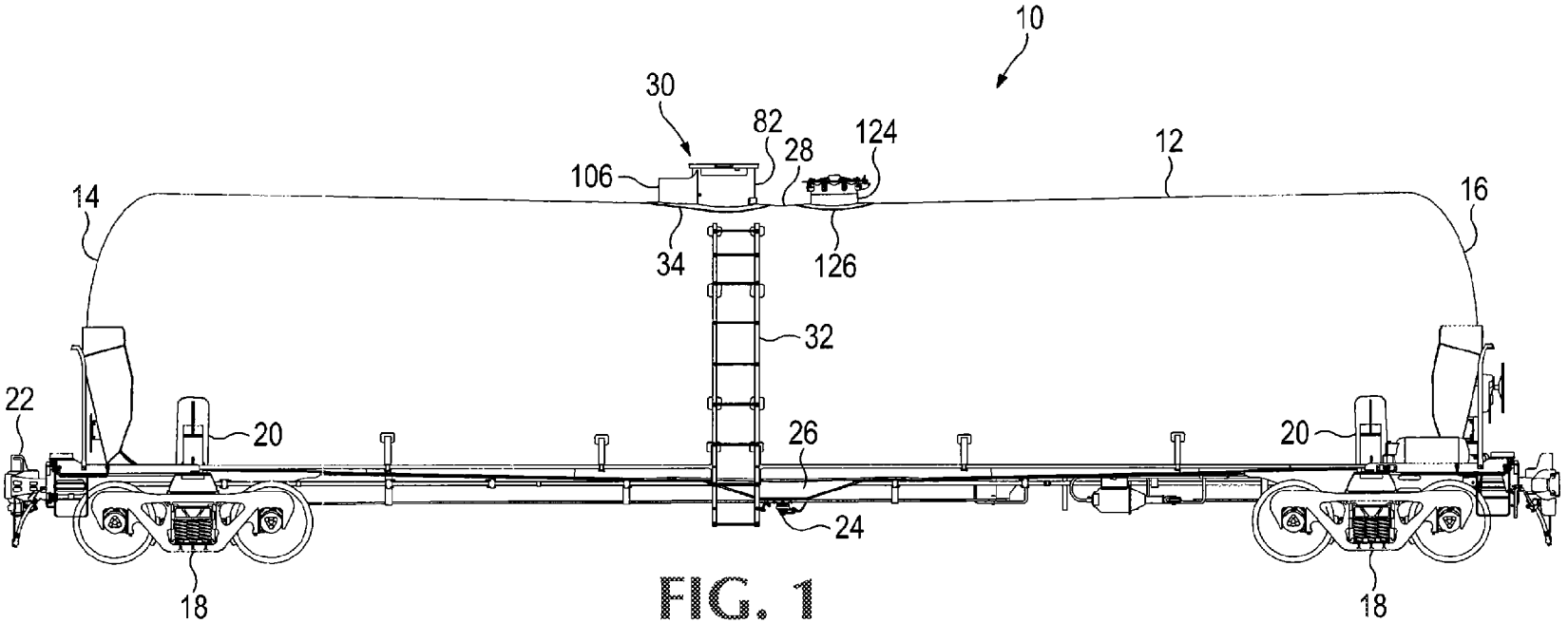
FIG. 1 is a side elevational view of a railway tank car, including a protective structure that is an embodiment of the present invention, for protecting various valves mounted on the top of the cargo tank of a railway tank car.

Referring now to the drawings which form a part of the disclosure herein, a railroad tank car 10 shown in FIG. 1 may include a generally cylindrical cargo tank 12 having a longitudinal axis 13. The opposite ends 14, 16 of the cargo tank 12 are closed, and the cargo tank 12 may be supported by a pair of wheeled trucks 18 that may be attached to the cargo tank 12 by appropriate conventional saddles and bolsters 20 connected with an outer surface of the cargo tank 12. The cargo tank 12 itself may be constructed with significant enough rigidity and strength not only to be self supporting, but to bear the longitudinal train loads exerted on the tank car 10 during travel.

A conventional double shelf coupler 22 may be provided at each end of the car. Centrally located in the bottom of the cargo tank there may be a bottom outlet valve 24 and conventional protective structures 26.

Located about mid-length of the tank car 10 and centrally along the top 28 of the cargo tank 12 is a protective structure 30. There may also be a walkway and a suitable hand rail (neither shown) alongside the protective structure, as well as a ladder 32 leading along the outside of the cargo tank toward the bottom of the car 10.

As shown at an enlarged scale in FIGS. 2-7, the protective structure 30 may be attached to a doubler plate such as a nozzle reinforcement pad 34 welded to an outer surface of the tank top 28 of the cargo tank 12. The nozzle reinforcement pad 34 may be a tapered oval in shape and may extend along the tank top 28 in a longitudinal direction with respect to the cargo tank 12. The nozzle reinforcement pad 34 may have a thickness 36 of, for example, about 0.5 inch, and may be of ASTM A 516 GR 70 steel.

Mounted on the cargo tank 12 at the location of the nozzle reinforcement pad 34 is a nozzle 40 provided with a closure member such as a valve group mounting plate 42 on which at least two valves may be mounted.

In order to reduce the likelihood of rollover damage to the nozzle 40 where the valve group mounting plate 42 is attached to the tank top, the nozzle 40 includes a bolting flange 44 for the valve group mounting plate 42 that is mounted on the tank top 28 at a lower height than has previously been known. A part 46 of the bolting flange 44 is located lower than the interior surface 47 of the cargo tank shell plating 48 at the tank top 28. A hoop-like bolting flange attachment skirt 50 of metal plate which may be generally cylindrical is securely fastened, as by welding, to the shell plating 48 of the cargo tank 12. The attachment skirt 50 extends above the cargo tank shell plating 48 and the nozzle reinforcement pad 34 mounted on the exterior of the cargo tank 12 by an exposure distance 52 such as about 1.25 inches, great enough to allow the attachment skirt 50 to be welded to the nozzle reinforcement pad 34 and to extend upwardly to a flat horizontal upper margin including a rim surface 54. A lower margin 56 of the attachment skirt 50 may be shaped to correspond with the shape of the opening through the cargo tank shell plating 48 for the nozzle 40. The attachment skirt 50 may extend downwardly within the interior of the cargo tank 12, preferably by a uniform distance, such as, for example, 0.25 to 0.50 inch, beyond the interior surface 47 of the shell plating 48, to present ample material of the attachment skirt 50 to be welded securely to the interior of the cargo tank shell plating 48.

The bolting flange 44 may be an annular monolithic steel member that fits snugly within the interior of the bolting flange attachment skirt 50 and is welded to the skirt 50, at both its upper margin 55, aligned with the top surface 54 of the bolting flange attachment skirt 50, and its lower margin 57. The bolting flange 44 may extend inward by a substantial radial width 60, such as about 3 inches, from the interior surface of the bolting flange attachment skirt 50 and may have a substantial vertical thickness or height 62 such as, for example, about 2 inches, so as to provide ample support for the plating 48 of the cargo tank 12, the nozzle reinforcement pad 34, and the bolting flange attachment skirt 50.

Figure 4:
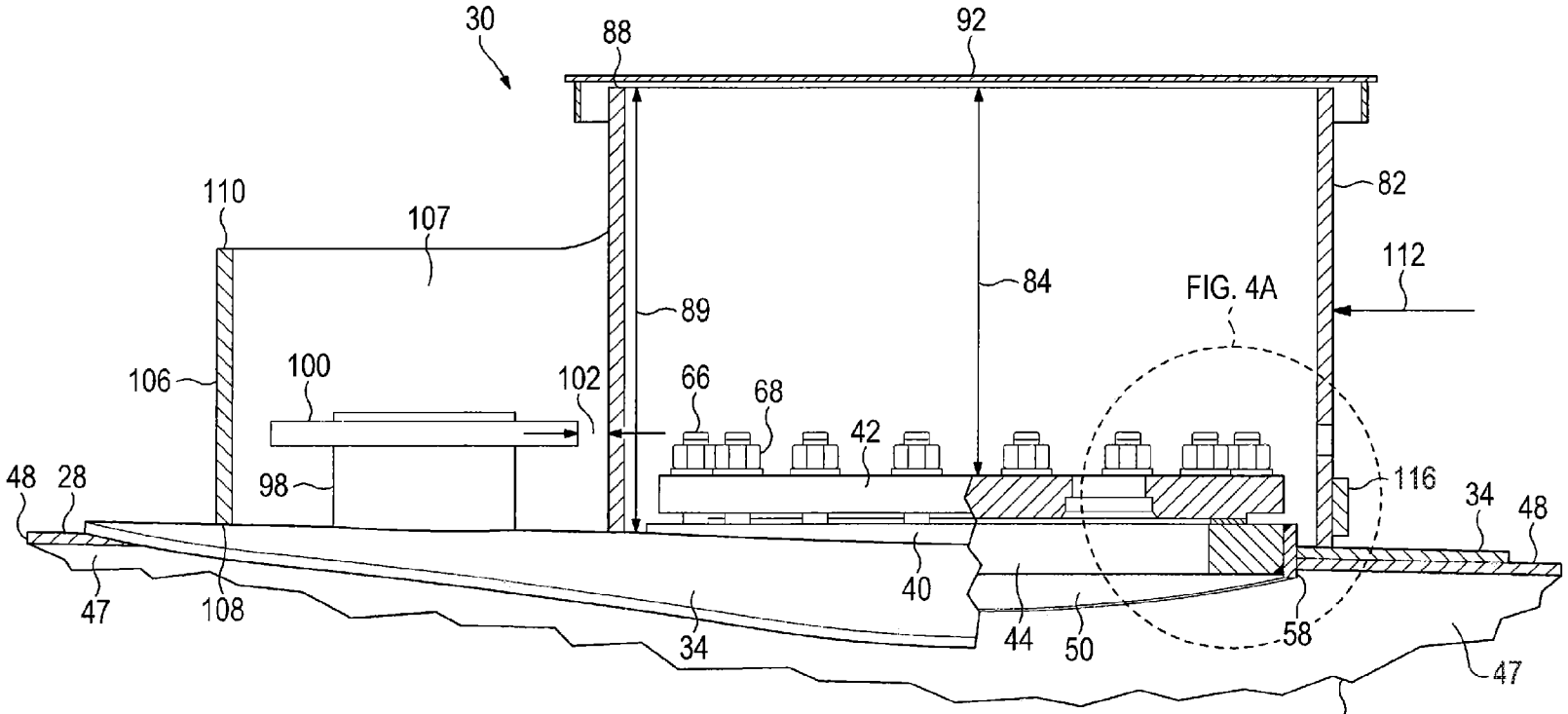
FIG. 4 is a sectional view, taken along the line 4-4 in FIG. 3.
Figure 4A:
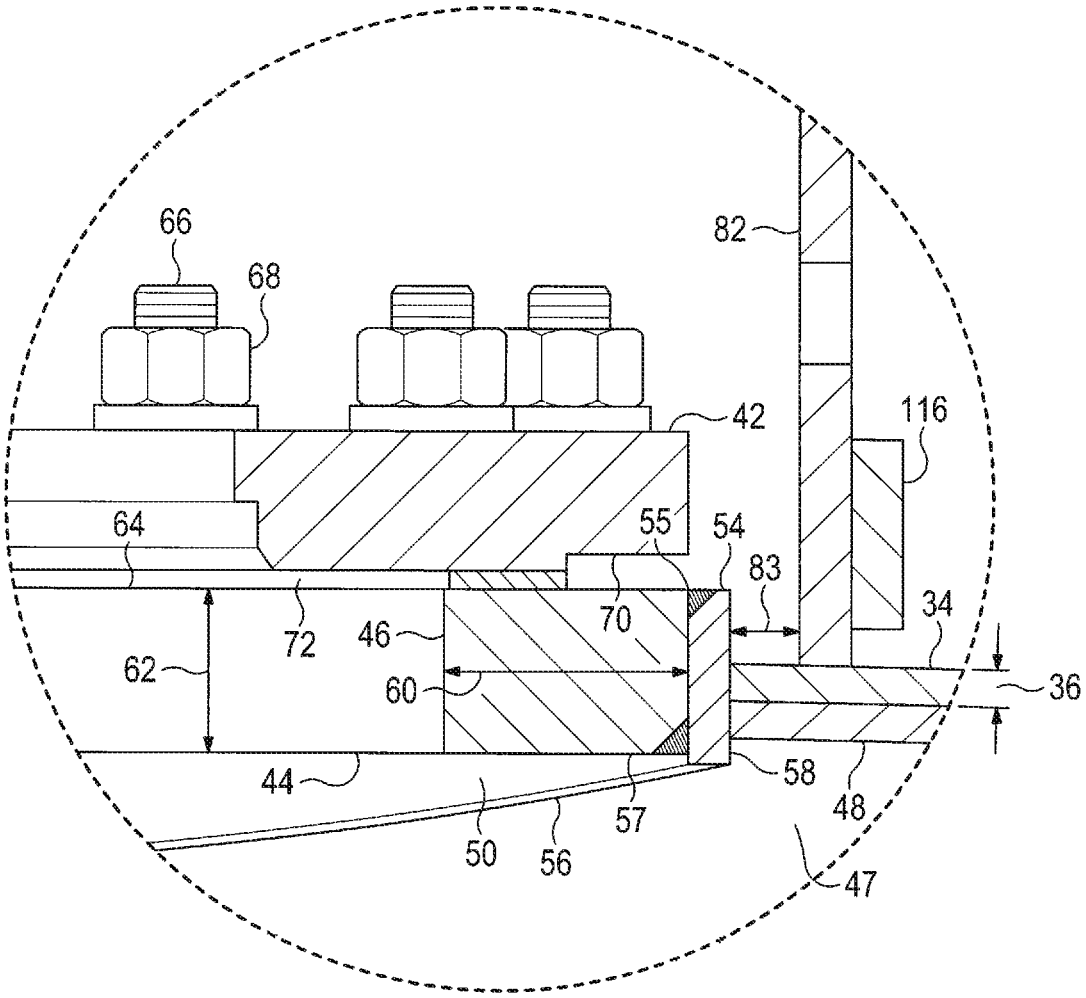
FIG. 4A is a detail view, at an enlarged scale, of the circled portion of FIG. 4.
Figure 5:
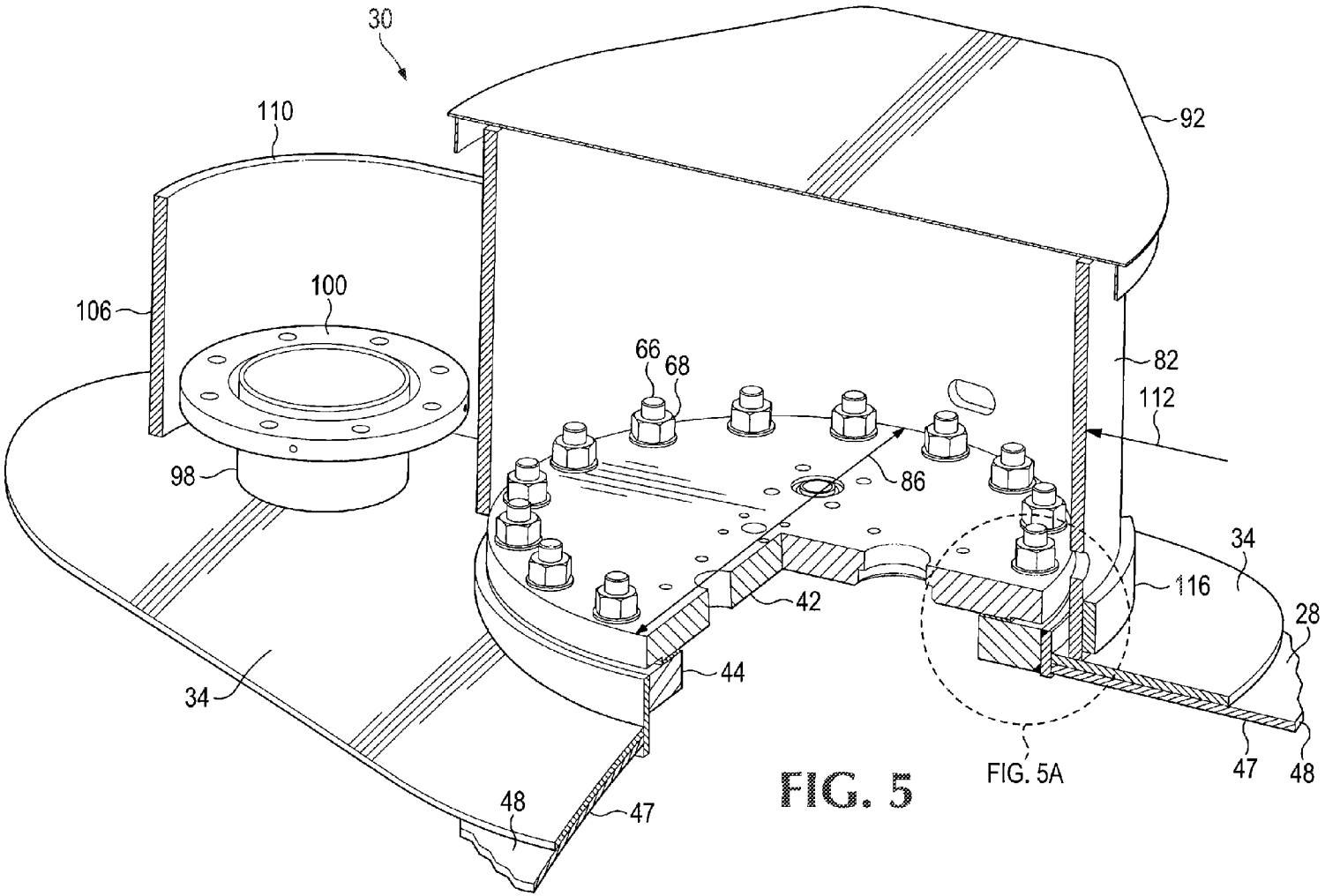
FIG. 5 is a partially cutaway isometric view taken from the upper right end of the portion of a railway tank car shown in FIG. 2.
Figure 5A:
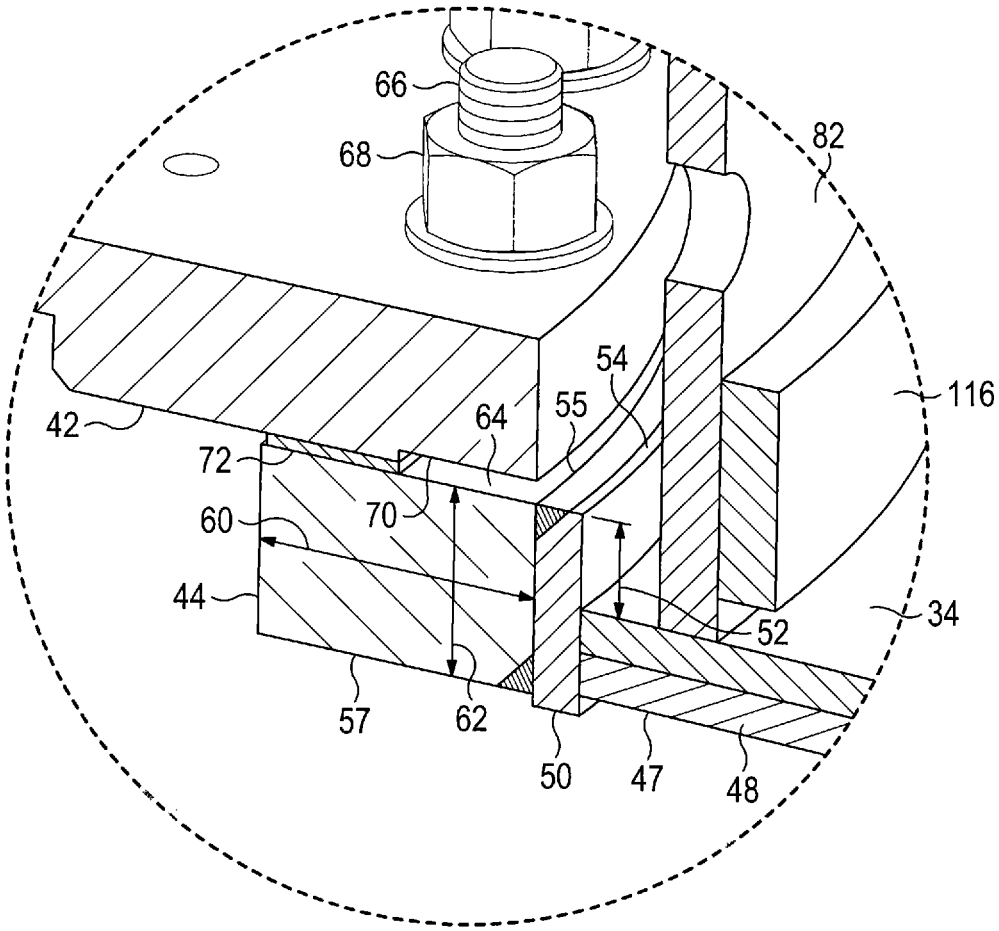
FIG. 5A is a detail view, at an enlarged scale, of the circled portion of FIG. 5.
Figure 6:
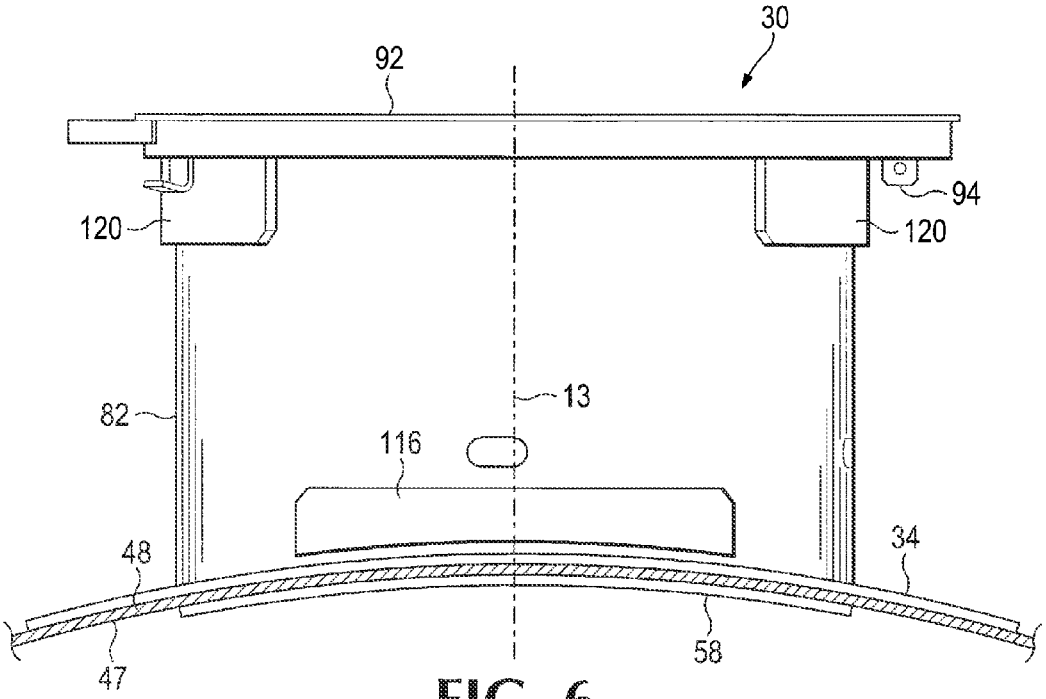
FIG. 6 is an end elevational view of the portion of a tank car shown in FIG. 2, taken in the direction of the line 6-6 in FIG. 3.

An upper face 64 of the bolting flange 44 may be planar, and a plurality of bolts 66 may be fastened to the bolting flange 44 and extend upwardly from the upper surface 64 in a circular arrangement. For example, the bolts 66 may be studs threaded into the bolting flange 44 and may be spaced apart from one another uniformly around the bolting flange 44. The upper face 64 of the bolting flange 44 may be flush with the upper face 54 of the bolting flange attachment skirt 50, as may be seen best in FIGS. 4A and 5A.

The valve group and fittings mounting plate 42 is provided with holes arranged to fit snugly over the bolts 66 and is fastened to the bolting flange 44 by nuts 68 threaded onto the bolts 66.

An outer margin portion 70 of the underside of the valve group and fittings mounting plate 42 may be undercut, and a suitable annular gasket 72 is fitted between the upper surface 64 of the radially inner part of the bolting flange and the full-thickness part of the mounting plate 42. The circular arrangement of the bolts 66, located radially outward from the gasket 72, may aid in keeping the gasket 72 in its desired location, while the undercut outer margin portion 70 of the mounting plate 42 directs tension in the bolts 66 to the full-thickness part of the mounting plate 42 to keep pressure on the gasket 72.

Various valves are mounted on the valve group and fittings mounting plate 42. For example, there may be a 3-inch diameter cargo delivery and removal valve 76 and a 2-inch diameter pressurized fluid admission valve 78. The cargo valve 76 may be connected with a fill pipe that extends nearly to the bottom of the cargo tank 12 to deliver cargo into the cargo tank 12 or to be used as a suction line to remove cargo from a sump in the bottom of the cargo tank 12. The fluid admission valve 78 may be used for introduction of pressurized air to aid in emptying the cargo tank 12, for example.

The protective structure 30 may include a protective housing 82 that encircles the flange attachment bolting skirt 50 and is fastened to the cargo tank 12 as by being welded to the nozzle reinforcement doubler pad 34. The protective housing 82 may be spaced outward from the exterior of the flange attachment bolting skirt 50 by a radial distance 83 of 0.75 inch, for example, affording room for welding the interior face of the protective housing 82 to the cargo tank 12 by welding it to the exterior surface of the nozzle reinforcement pad 34, and providing space around the valve group and fittings mounting plate 42. The protective housing 82 may also be of a suitable relatively high-strength steel such as, for example, A516 GR 70 plate 0.625 inch thick, although a higher strength steel or greater thickness may be determined by engineering calculations to be better able to withstand potential forces, depending on the designed size and capacity of the tank car 10. The protective housing 82 extends upward to a height 84 above the valve and fittings mounting plate to at least the height of the tallest of the valves 76 and 78 or other fittings expected to be mounted on the mounting plate 42.

Because a pressure-relief safety valve that is commonly the tallest valve associated with the top of a cargo tank of a railway tank car is not located on the valve group and fittings mounting plate 42, the protective housing 82 may have a shorter height 84 than would be necessary were the pressure-relief safety valve mounted on the valve group mounting plate 42. Additionally, with fewer valves mounted on the valve group and fittings mounting plate 42, because of the pressure-relief safety valve being mounted elsewhere, the diameter 86 of the valve group mounting plate 42 can be smaller, for example, about 25 inches.

Thus, the top 88 of the protective housing 82 may, for example, be located only about 16 inches above the upper face of the valve group and fittings mounting plate 42. The height 89 of the top 88 of the valve group protective housing may thus be less than 18.5 inches above the nozzle reinforcement pad 34 at the longitudinal center line of the tank top 28. The height 90 of the top 88 of the protective housing 82 will be greater at the furthest lateral part of the protective housing 82, because of the downward curvature of the cargo tank 12, where the height 90 may be about 20 inches. Because the bolting flange 44 is mounted low, at the lowest practical location with respect to the tank top, the protective housing 82 extends upward above the tank top 28 of the cargo tank 12 by a minimum distance, resulting in a minimized exposure of the valves 76 and 78 and any other tank top fittings to damage in the event of the railway tank car 10 being overturned.

A lid 92 which may be constructed of heavy sheet metal, may be mounted on the top 88 of the protective housing 82 by a hinge 94 to cover the space defined by the protective housing 82 surrounding the valve group nozzle 40 and the associated valves. The hinged lid 92 provides protection of the valves 76 and 78 on the valve group and fixtures mounting plate 42 from the weather and from easy tampering and may be secured in a manner by which any tampering is clearly evident, such as by a hasp and padlock arrangement (not shown) connecting the lid 92 to the opposite side of the protective housing 82 with an accompanying tamper-evident seal. The lid 92 may be raised to provide access to the valves 76 and 78 and other fittings for maintenance and for connection of suitable conduits for delivering cargo into, or for removal of cargo from, the interior of the cargo tank 12, and for providing fluid such as a suitable gas under pressure into the cargo tank 12 to assist in urging cargo out through the bottom outlet valve 24.

A pressure-relief safety valve 96 may be mounted on its own nozzle 98 and at its own separate second opening through the tank top 28 at a location along the top of the cargo tank 12 longitudinally separate from the nozzle 40 on which the valve group and fixtures mounting plate 42 may be mounted. The nozzle 98 and an associated mounting flange 100 on which the pressure-relief safety valve 96 is mounted may be spaced apart from the protective housing 82 in a longitudinal direction with respect to the cargo tank 12, by a distance 102, between the protective housing 82 and the flange 100, great enough to provide necessary space for attachment, adjustment, or removal of the pressure-relief safety valve 96.

Figure 3:
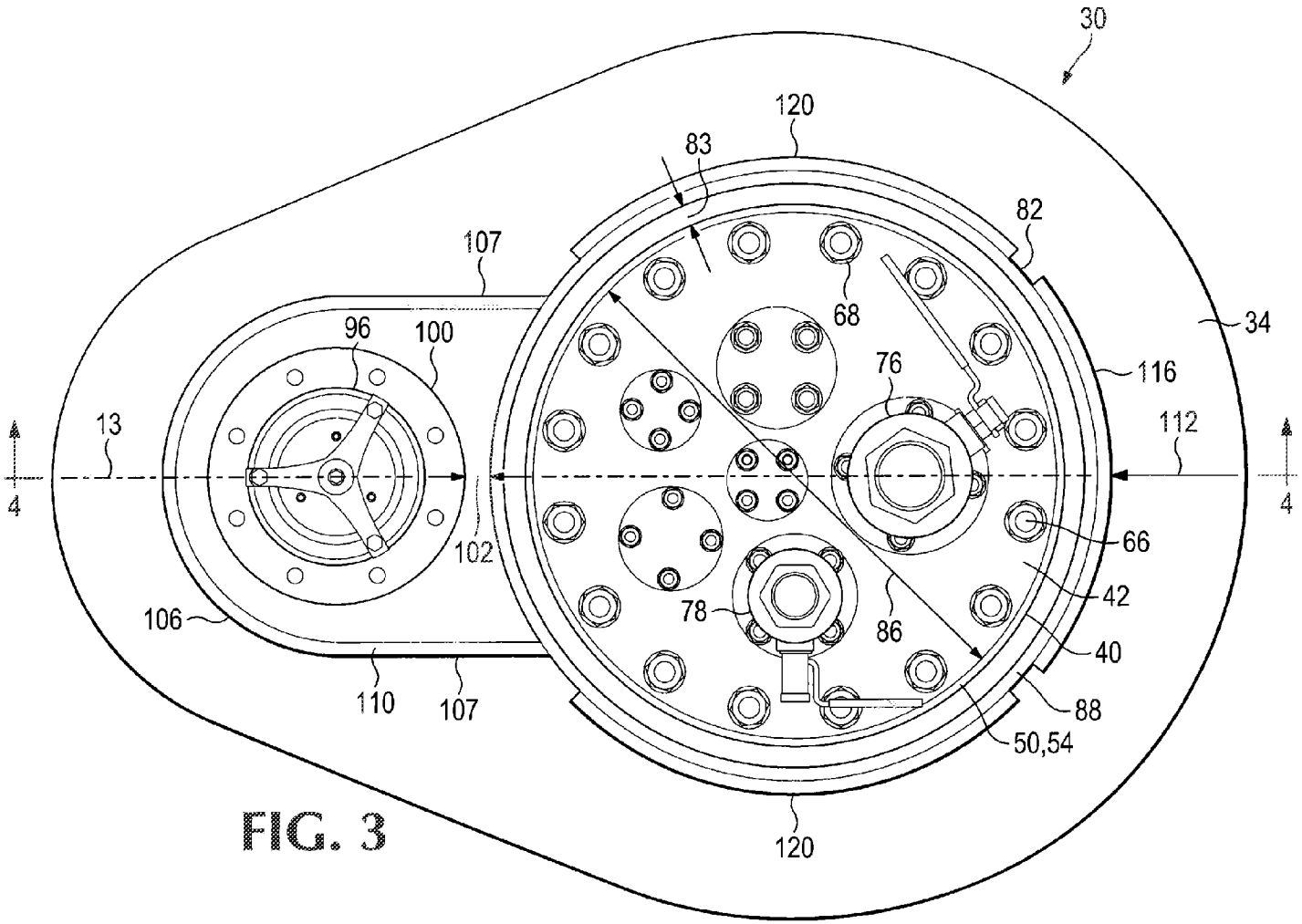
FIG. 3 is a top plan view of the protective structure shown in FIG. 2.

An auxiliary protective housing 106, which may be constructed of metal plate similar to that of the protective housing 82, surrounds the valve group and fittings mounting plate 42, and may be in the form of a "U," as seen in plan view in FIG. 3. The legs 107 of the "U" may extend parallel with each other to the protective housing 82 and may be attached to the protective housing, as by welding , leaving an upwardly-open path for fluid discharged from the pressure-relief safety valve 96. A bottom margin 108 of the auxiliary protective housing 106 may be welded to the nozzle reinforcement pad 34, while an upper margin 110 of the auxiliary protective housing 106 is left uncovered so that the auxiliary protective housing 106 defines an upwardly-open around the pressure-relief safety valve 96 and its associated mounting flange 100 and nozzle 98.

Figure 2:
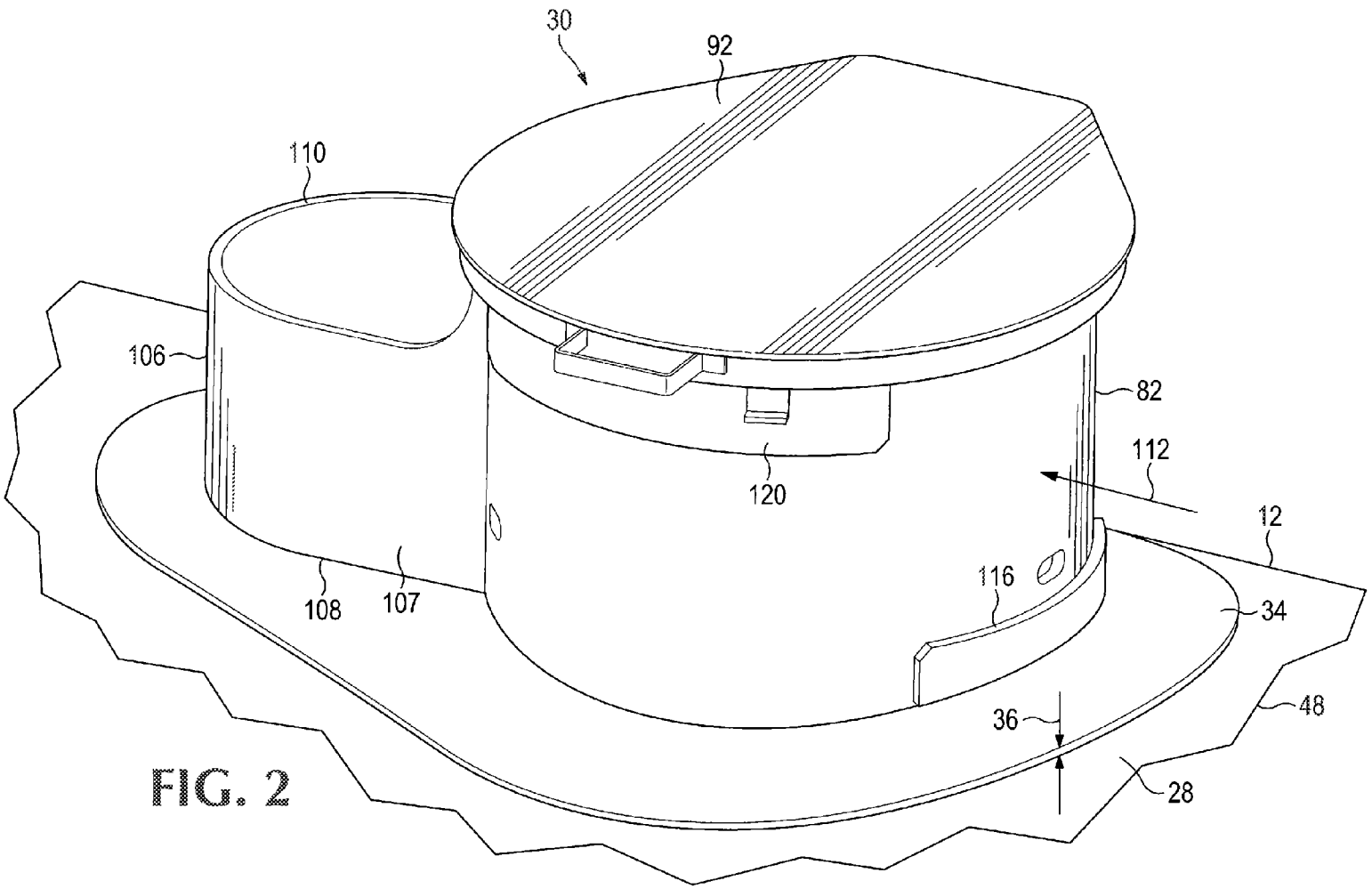
FIG. 2 is an isometric view, at an enlarged scale, of a portion of the tank car shown in FIG. 1 including the protective structure shown in FIG. 1.

The auxiliary protective housing 106 also functions as a buttress to support the protective housing 82 surrounding the valve group mounting plate against forces applied to the right side of the protective structure 30 as indicated by the arrow 112 in FIG. 2.

Figure 7:
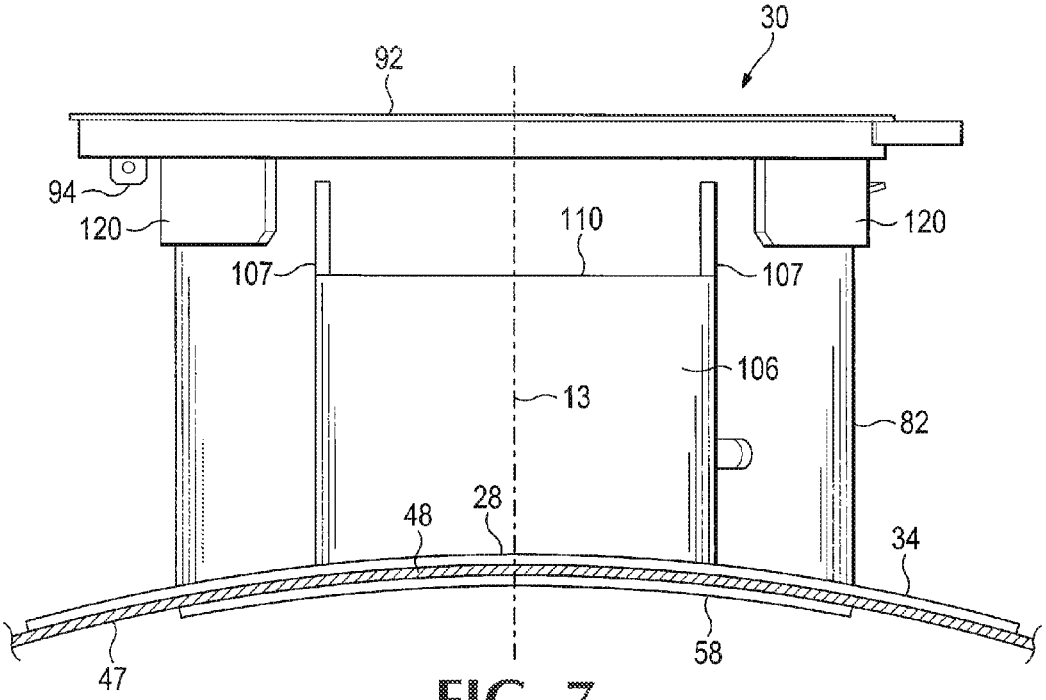
FIG. 7 is an end elevational view taken in the direction of the line 7-7 in FIG. 3.

A horizontally oriented oblong doubler plate 116 is fastened, as by welding, to the lower portion of the protective housing 82, as may be seen best in FIG. 7, thus strengthening the protective housing 82 near the tank top 28 and the valve group and fittings mounting plate 42. A pair of similar doubler plates 120 of slightly greater size are also mounted on the opposite lateral sides of the protective housing 82 near its top 88, as may be seen in FIGS. 1, 2, 3, 6, and 7, where they may function to stiffen the protective housing 82 and help it to resist deformation in the event of forces applied to it in the direction of the arrow 112.

The tank top 28 may also be provided with a manway nozzle 124 connected with and extending upward from a related opening through the tank top 28. The tank top 28 may be suitably reinforced around the manway nozzle 124, as by a doubler plate 126 of suitable strength extending radially outward from the manway nozzle 124 and welded to the exterior of the tank shell plating 48. The manway nozzle 124 may be provided with a closure member, such as a conventional manway cover 128 attached by suitable fasteners such as pivoted eyebolts 130 and nuts. The cover 128 may be connected with the nozzle 124 by a hinge 130 permitting the cover 128 to be opened to provide access for personnel to inspect or repair the interior of the cargo tank 12. Such a manway nozzle 124 need not extend upward above the tank top 28 more than a minimal distance, and is therefore the less likely to be damaged than the valves and other fittings protected by the protective structure 30.

The cargo tanks 12 of some railway tank cars 10 intended to carry some types of cargo may be jacketed with a layer of a thermal insulation (not shown), which may overlap the doubler pad 34 in the vicinity of the protective structure 30.

The terms and expressions that have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A railway tank car comprising:

(a) a cargo tank for containing fluid cargo and having a tank wall of an elongate, generally cylindrical configuration including a vertical longitudinal central plane, a pair of opposite ends, and a tank top, the tank wall having an exterior surface and an interior surface;

(b) a first opening defined through the tank wall at the tank top of the cargo tank;

(c) a flange attachment skirt located within the first opening and extending through and around the first opening and upward above the tank top to a planar upper margin of the flange attachment skirt, the flange attachment skirt having an interior surface adjacent its planar upper margin;

(d) an annular valve group mounting flange having an upper surface and a bottom surface spaced apart from the upper surface by a flange thickness, the mounting flange being located within the flange attachment skirt and being fastened to the interior surface of the flange attachment skirt;

(e) a valve group and fittings mounting plate;

(f) a plurality of mechanical fasteners attaching the mounting plate to the upper surface of the flange; and (g) a protective structure attached to the tank top and surrounding the first opening and the valve group mounting flange.

2. The railway tank car of claim 1, the tank top including a doubler plate, and the protective structure including a protective housing including an upstanding wall of metal plate material attached to the tank top, surrounding the first opening defined through the tank wall, and spaced radially outwardly apart from the flange attachment skirt.

3. The railway tank car of claim 2, including a pressure-relief valve and a pressure-relief valve nozzle at a separately located second opening spaced apart from the first opening in a longitudinal direction with respect to the cargo tank, and wherein the upstanding wall of the protective housing has a lower margin welded to the doubler plate, the protective structure also including an auxiliary protective housing for the pressure-relief valve in the form of an upstanding wall of metal plate material spaced apart radially outward from the pressure-relief valve nozzle and having a pair of opposite side portions, each attached to the upstanding wall of the protective housing and extending on opposite lateral sides of the pressure-relief valve nozzle, and a portion interconnecting the side portions and extending around the pressure-relief valve nozzle.

4. The railway tank car of claim 1 including a separate pressure-relief valve nozzle at a separately located second opening spaced apart from the first opening in a longitudinal direction with respect to the cargo tank, the tank car further including a reinforcing pad including a doubler plate attached to the tank top of the cargo tank, extending in the longitudinal direction with respect to the cargo tank and surrounding the first opening, the separately located second opening through the tank wall, and the pressure-relief valve nozzle.

5. A protective structure for protecting a nozzle and a tank top part of a fluid cargo tank including a first opening, a valve group nozzle, and a valve mounting plate covering the first opening, and including a second opening and a pressure-relief valve nozzle mounted on the tank top and spaced apart longitudinally of the cargo tank from the first opening, the protective structure comprising:

(a) a nozzle reinforcement pad including a doubler plate attached to the tank top and surrounding the first opening, the doubler plate extending to the second opening and surrounding the second opening and the pressure-relief valve nozzle;

(b) a protective housing including an upstanding wall of metal plate material surrounding the first opening and the valve mounting plate and having a lower margin welded to the doubler plate; and (c) an auxiliary protective housing for the pressure-relief valve nozzle, attached to the nozzle reinforcement pad and including an upstanding wall of metal plate material, the upstanding wall of the auxiliary protective housing having a pair of opposite side portions each attached to the upstanding wall of the protective housing surrounding the first opening and extending on opposite lateral sides of the pressure-relief valve nozzle and having a portion interconnecting the side portions and extending around the pressure-relief valve nozzle.

6. The protective structure of claim 5 wherein the protective housing includes a reinforcing doubler plate welded to the upstanding wall surrounding the first opening, the reinforcing doubler plate being located upwardly adjacent to the nozzle reinforcement pad and facing toward an end of the fluid cargo tank.

7. A railway tank car comprising:

(a) a cargo tank for containing fluid cargo and having an elongate generally cylindrical configuration including a pair of opposite ends and a tank top;

(b) a first opening defined in the tank top of the cargo tank and a smaller second opening defined in the tank top and spaced a distance apart from the first opening;

(c) a valve group nozzle communicating with an interior of the cargo tank and extending through the first opening and having a portion located above the tank top;

(d) a closure member associated with the valve group nozzle;

(e) a protective housing attached to the top of the cargo tank, the protective housing being spaced apart from and surrounding the valve group nozzle and the associated closure member, the protective housing including a first upstanding wall of metal plate construction;

(f) a pressure-relief safety valve connected with the tank top and communicating with the interior of the cargo tank through the second opening defined in the tank top;

(g) an auxiliary protective housing attached to the tank top and to the first upstanding wall of the protective housing, the auxiliary protective housing including a second upstanding wall of metal plate construction having a pair of ends, spaced apart from each other laterally of the car and attached to the first upstanding wall of the protective housing, and having an intermediate portion, spaced apart from the first upstanding wall and interconnecting the ends of the second upstanding wall and extending around the pressure-relief safety valve, the second upstanding wall having a lower margin attached to the top of the cargo tank, and the second upstanding wall defining an upwardly-open space surrounding the pressure-relief safety valve.

8. The railway tank car of claim 7 wherein the valve group nozzle includes a flange attachment skirt located within the first opening and extending through the first opening and upward above the tank top to an upper margin, the flange attachment skirt having an interior surface adjacent its upper margin, and the tank car including an annular valve group mounting flange having a horizontal upper surface and a bottom surface spaced apart from the upper surface by a flange thickness, the valve group mounting flange extending radially inward within the flange attachment skirt and having an upper margin fastened to the interior surface of the flange attachment skirt adjacent the upper margin thereof.

9. The railway tank car of claim 8 wherein the valve group mounting flange has a bottom surface attached to the interior surface of the flange attachment skirt and has at least a portion of its bottom surface located no higher than an interior surface of a tank wall of the cargo tank.

10. The railway tank car of claim 7 further including a nozzle reinforcement pad in the form of a doubler plate welded to an exterior surface of the tank top and extending around and between the first opening and the second opening in the tank top.

* * * * *